US010276927B2

(12) United States Patent
Ohno et al.

(10) Patent No.: US 10,276,927 B2
(45) Date of Patent: Apr. 30, 2019

(54) VEHICLE ANTENNA DEVICE

(71) Applicant: YOKOWO CO., LTD., Kita-ku, Tokyo (JP)

(72) Inventors: Sadao Ohno, Tomioka (JP); Kengo Osawa, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 14 days.

(21) Appl. No.: 15/329,309

(22) PCT Filed: May 20, 2015

(86) PCT No.: PCT/JP2015/064422
§ 371 (c)(1),
(2) Date: Jan. 26, 2017

(87) PCT Pub. No.: WO2016/017247
PCT Pub. Date: Feb. 4, 2016

(65) Prior Publication Data

US 2017/0214129 A1 Jul. 27, 2017

(30) Foreign Application Priority Data

Jul. 28, 2014 (JP) ..... 2014-152996

(51) Int. Cl.
*H01Q 1/32* (2006.01)
*H01Q 1/52* (2006.01)

(52) U.S. Cl.
CPC ..... *H01Q 1/3275* (2013.01); *H01Q 1/52* (2013.01); *H01Q 1/521* (2013.01)

(58) Field of Classification Search
CPC ..... H01Q 1/3275
USPC ..... 343/711–713
See application file for complete search history.

(56) References Cited

U.S. PATENT DOCUMENTS

| | | | | |
|---|---|---|---|---|
| 6,288,684 | B1 * | 9/2001 | Wiggenhorn | H01Q 1/1207 335/288 |
| 7,079,079 | B2 * | 7/2006 | Jo | H01Q 1/243 343/700 MS |
| 2003/0137463 | A1 * | 7/2003 | Shimizu | H01Q 1/241 343/713 |
| 2008/0117111 | A1 | 5/2008 | Ikeda et al. | |
| 2008/0129620 | A1 * | 6/2008 | Zurowski | H01Q 1/1214 343/713 |
| 2009/0207084 | A1 | 8/2009 | Ikeda et al. | |

(Continued)

FOREIGN PATENT DOCUMENTS

| | | | |
|---|---|---|---|
| JP | 2002-094320 | A | 3/2002 |
| JP | 2012-204996 | A | 10/2012 |

(Continued)

OTHER PUBLICATIONS

International Search Report dated Jun. 16, 2015, for International application No. PCT/JP2015/064422.

*Primary Examiner* — Dameon E Levi
*Assistant Examiner* — Hasan Z Islam
(74) *Attorney, Agent, or Firm* — Morgan, Lewis & Bockius LLP

(57) ABSTRACT

A vehicle antenna device includes: an antenna base; an antenna case which is overlaid on the antenna base; and an antenna element and an amplifier board which are disposed inside the antenna case. The antenna element has a capacitive element and a coil element, and a filter board is disposed between the capacitive element and the coil element.

11 Claims, 16 Drawing Sheets

(56) References Cited

U.S. PATENT DOCUMENTS

| | | | | |
|---|---|---|---|---|
| 2013/0229315 | A1* | 9/2013 | Duzdar | H01Q 1/3275 343/713 |
| 2014/0125549 | A1 | 5/2014 | Kaneko | |
| 2014/0125550 | A1 | 5/2014 | Kaneko | |
| 2014/0159964 | A1 | 6/2014 | Kaneko | |
| 2014/0340267 | A1* | 11/2014 | Kim | H01Q 1/3275 343/713 |
| 2015/0200446 | A1 | 7/2015 | Kaneko | |

FOREIGN PATENT DOCUMENTS

| | | | |
|---|---|---|---|
| JP | 2013-229813 | A | 11/2013 |
| WO | 2008/062746 | A1 | 5/2008 |

* cited by examiner

COMPARISON EXAMPLE 1

COMPARISON EXAMPLE 2

VEHICLE ANTENNA DEVICE

TECHNICAL FIELD

The present invention relates to a vehicle antenna device which is to be mounted, for example, on a roof of a vehicle.

BACKGROUND ART

Recently, an antenna which is called a shark fin antenna has been developed. As an AM/FM antenna element, a combination of an umbrella-shaped capacitive element and a coil element is widely used. From the viewpoint of multifunctionalization, in addition to an AM/FM antenna, an antenna for data communication such as the LTE, a satellite radio antenna, and the like may be combined with one another.

CITATION LIST

Patent Literature

Patent Literature 1: JP-A-2012-204996
Patent Literature 2: JP-A-2013-229813

SUMMARY OF INVENTION

Technical Problem

A vehicle antenna device which is small in appearance is preferred. When several kinds of antennas are combined with one another as described above, therefore, a plurality of antenna elements are disposed in proximity in an antenna case, and there arises a new problem in that the antenna elements interfere with one another.

The present invention has been conducted in view of such circumstances. It is an object of the present invention to provide a vehicle antenna device in which interferences in an antenna case can be suppressed.

Solution to Problem

An aspect of the invention is a vehicle antenna device. The vehicle antenna device includes:

an antenna base;

an antenna case which is overlaid on the antenna base; and an antenna element and an amplifier board which are disposed inside the antenna case, the antenna element has a capacitive element and a coil element, and a filter board is disposed between the capacitive element and the coil element.

The coil element may be configured by forming a winding around a bobbin, a first terminal to which one end of the coil element is electrically connected may be disposed on a side of one end of the bobbin, and a lower surface of the filter board may be in contact with and electrically connected to the first terminal, and an upper surface of the filter board may be in contact with and electrically connected to the capacitive element.

Connecting portions of the first terminal, the filter board, and the capacitive element may be screwed to the antenna case in a state where the connecting portions overlap with one another, and electrically connected to one another at the screwed portions.

The vehicle antenna device may include an element holder which supports the capacitive element and the coil element, and the element holder may have a placement portion on which the filter board is to be placed.

The placement portion may slidably support the filter board, and the filter board is latched by a latching claw at a predetermined slide position.

The antenna element may include another antenna element for a frequency band which is different from a frequency band received by the capacitive element and the coil element.

The antenna base may have a resin-made base having an opening, and a metal-made base which is smaller in area than the resin-made base, which is disposed on the resin-made base so as to close the opening, and which has a screw shaft for attachment to a vehicle body, and a conductor plate may be attached to a surface of the resin-made base, the surface being opposite to a placement surface of the metal-made base.

The conductor plate may be electrically connected to the metal-made base.

In the conductor plate, as viewing in an axial direction of the screw shaft, an outer edge excluding a side facing a side of the screw shaft may approximately coincide with an outer edge of the metal-made base, or be outside the outer edge of the metal-made base.

The conductor plate may have at least one plate spring portion which extends so as to approach a vehicle body.

The conductor plate may be disposed respectively in front and rear of the screw shaft.

In the metal base, a resin-made part which prevents the metal base from being directly contacted with an inner circumferential portion of a mounting hole of a vehicle body may be disposed in a portion opposed to the inner circumferential portion of the mounting hole.

The resin-made part may be a holder for provisionally fixing the vehicle antenna device to a vehicle body.

A boss which is engaged with an inner circumferential portion of a mounting hole of a vehicle body may be disposed on a surface of the resin-made base, the surface being on a side of the vehicle body.

Arbitrary combinations of the above-described components, and expressions of the present invention which are converted in method and system are also effective as aspects of the present invention.

Advantageous Effects of Invention

According to the present invention, it is possible to provide a vehicle antenna device in which interferences in an antenna case can be suppressed.

DESCRIPTION OF EMBODIMENTS

Figure 1:
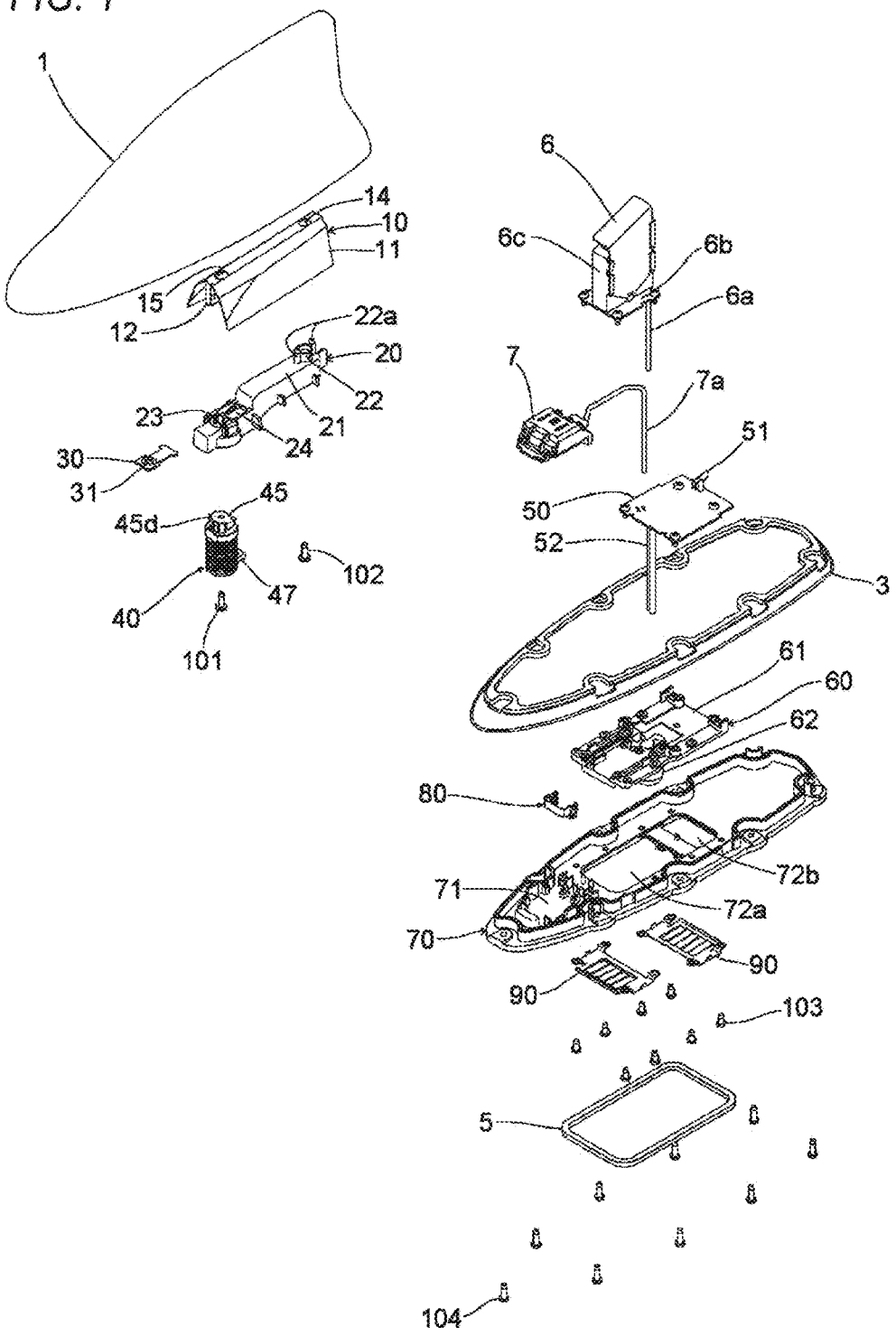
FIG. 1 is an exploded perspective view of a vehicle antenna device according to an embodiment of the present invention.

Hereinafter, a preferred embodiment of the present invention will be described in detail with reference to the drawings. Identical or equivalent components, members, and the like shown in the drawings are denoted by the same reference numerals, and duplicated descriptions are appropriately omitted. The embodiment does not limit the invention, but only exemplifies the invention, and all features described in the embodiments, and their combinations are not necessarily essential in the invention.

Figure 2:
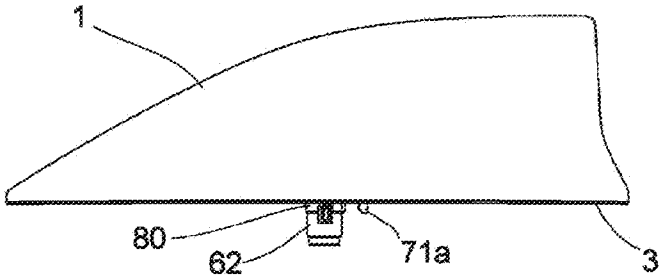
FIGS. 2(A), 2(B) and 2(C) are external views of the vehicle antenna device.
Figure 2:
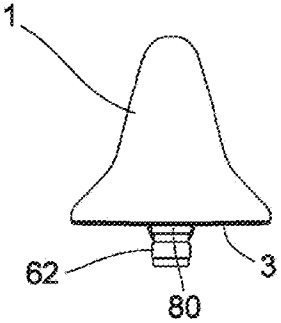
Figure 2:
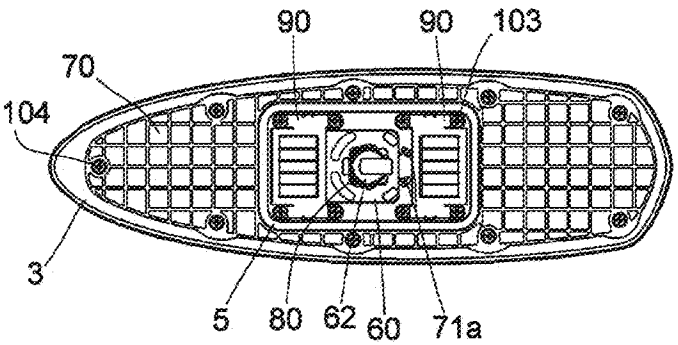
Figure 3:
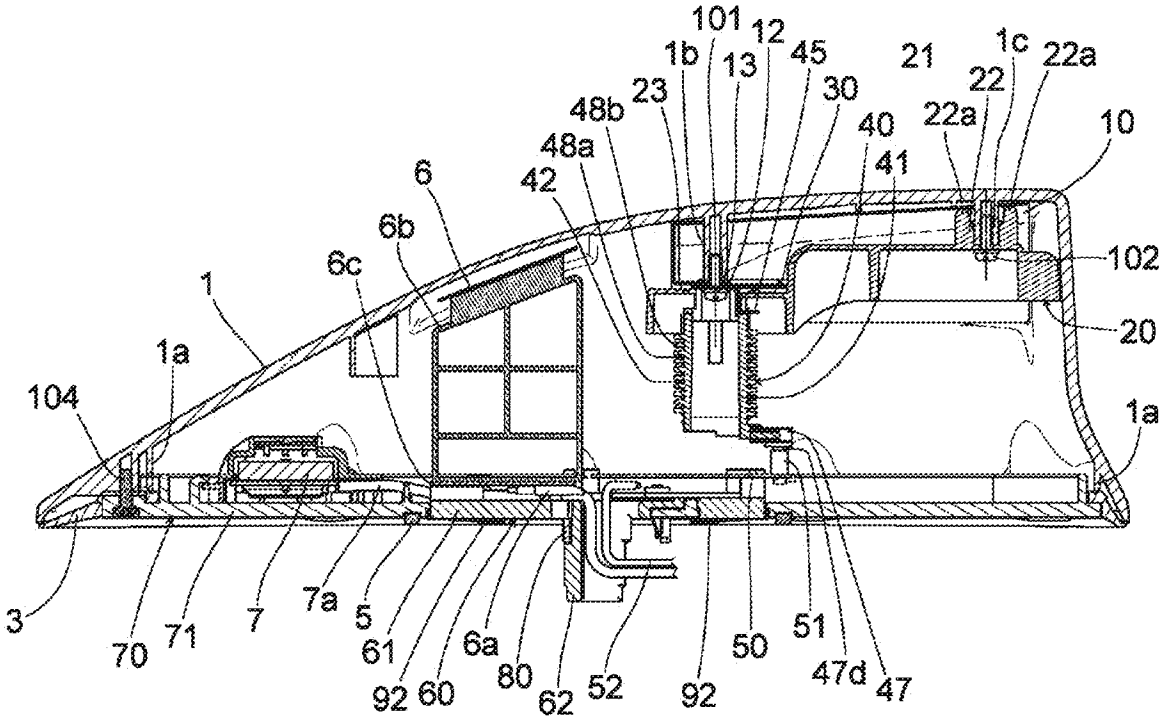
FIG. 3 is a side sectional view of the vehicle antenna device.
Figure 4:
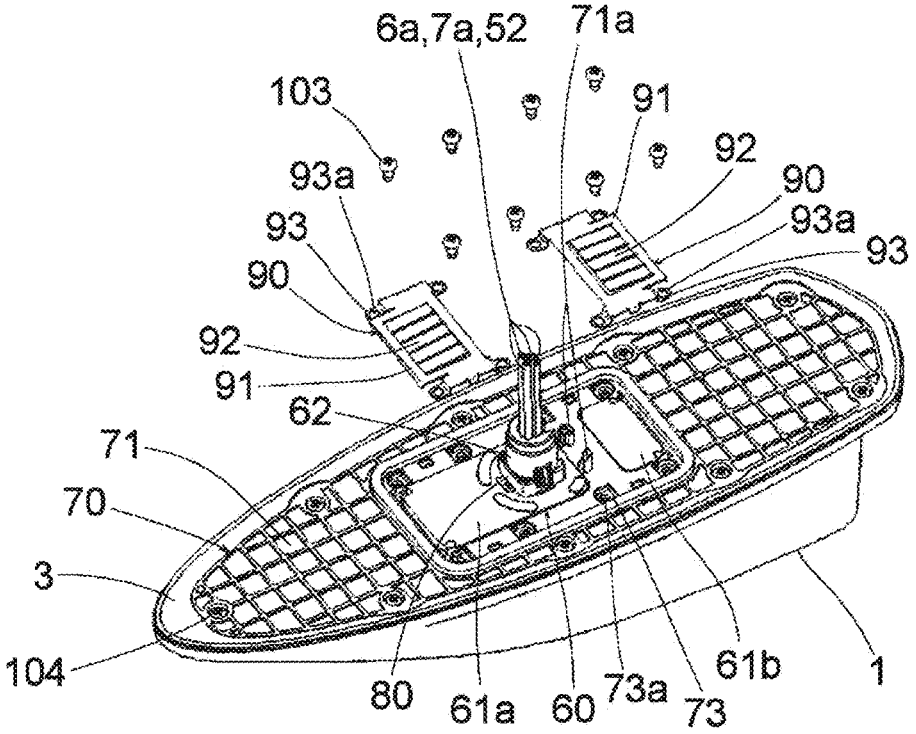
FIG. 4 is a perspective view of the vehicle antenna device in a state where conductor plates 90 are disassembled, as seen from the lower side.
Figure 5:
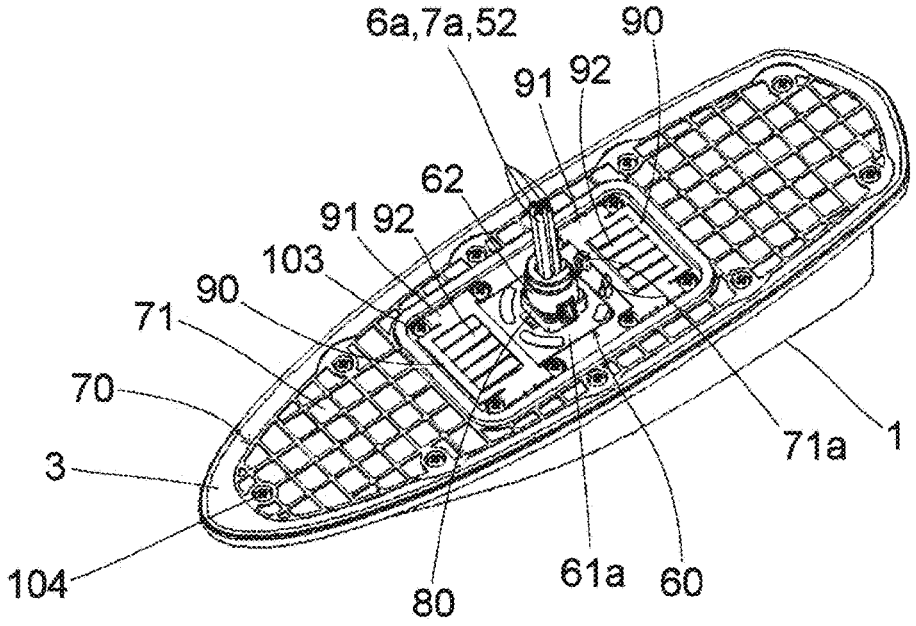
FIG. 5 is a perspective view of the vehicle antenna device, as seen from the lower side.
Figure 6:
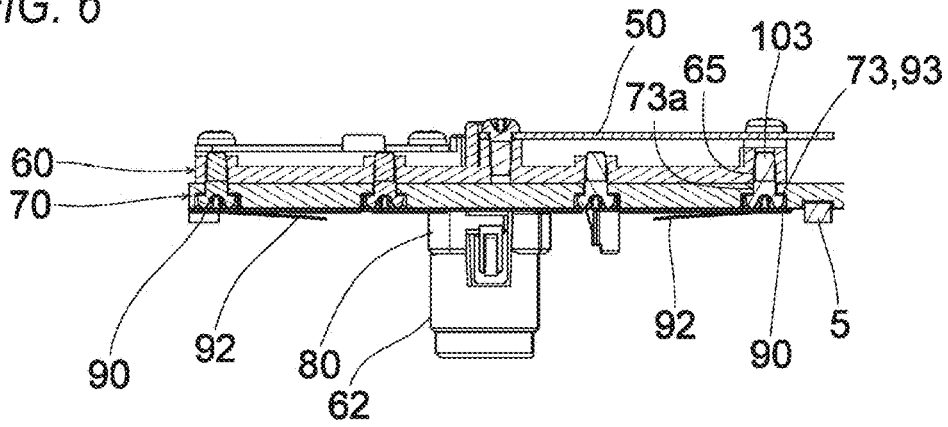
FIG. 6 is an enlarged sectional view taken along A-A in FIG. 2(C).
Figure 7:
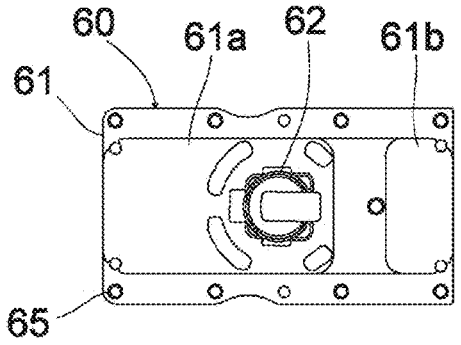
FIGS. 7(A) to 7(D) are external views of a metal-made base 60 in FIG. 1.
Figure 7:
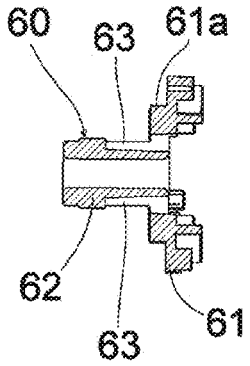
Figure 7:
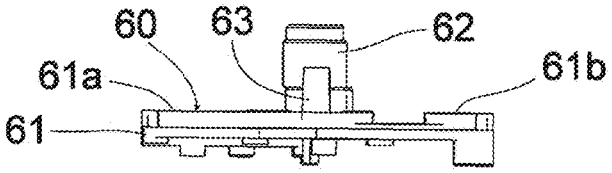
Figure 7:
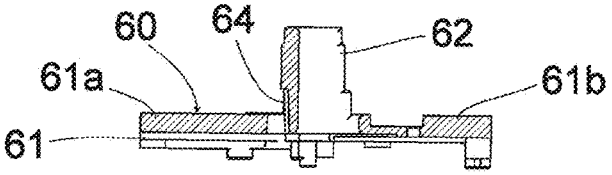
Figure 8:
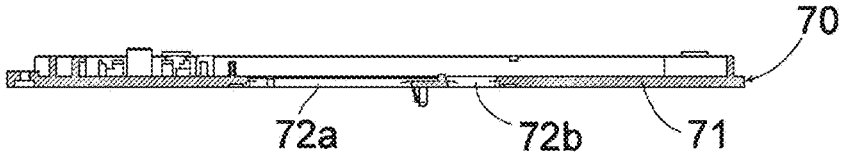
FIGS. 8(A), 8(B) and 8(C) are external views of a resin base 70 in FIG. 1.
Figure 8:
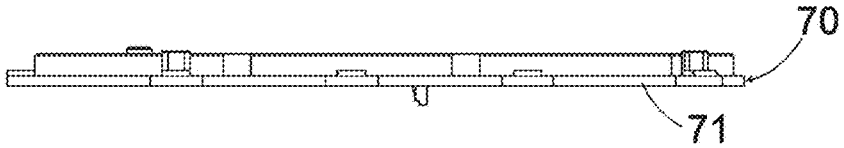
Figure 8:
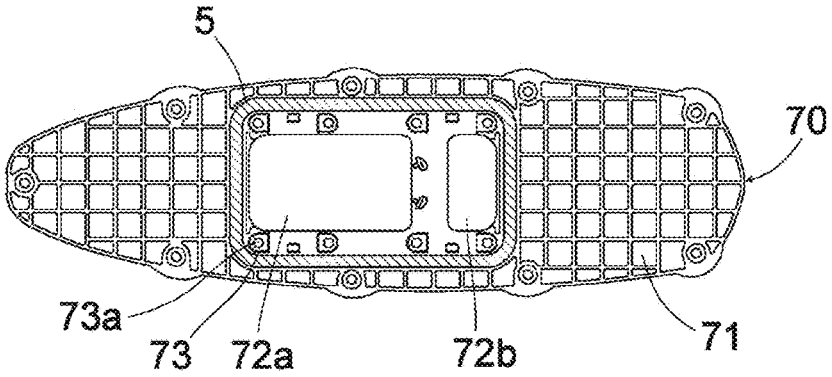
Figure 9:
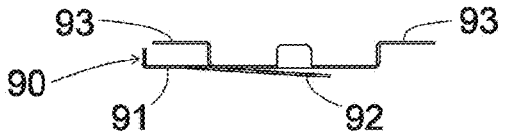
FIGS. 9(A), 9(B) and 9(C) are external views of the conductor plate 90 in FIG. 1.
Figure 9:
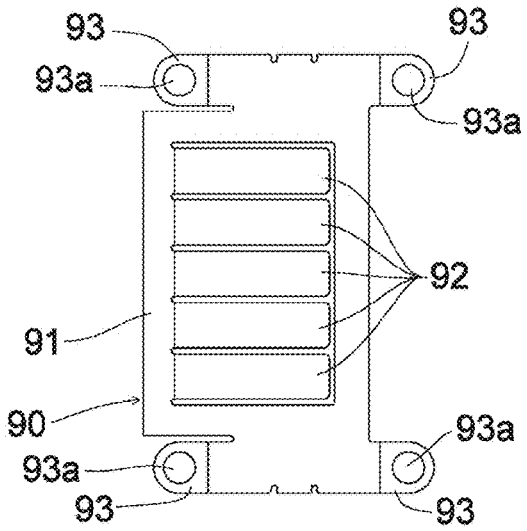
Figure 9:
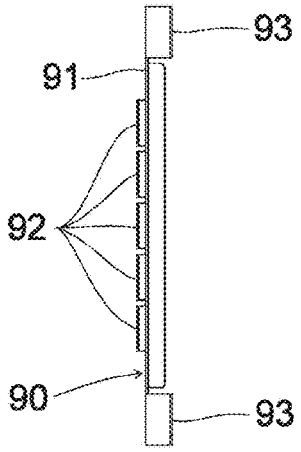

FIG. 1 is an exploded perspective view of a vehicle antenna device of the embodiment according to the present invention. FIG. 2(A) is a front view of the vehicle antenna device. FIG. 2(B) is a side view of the vehicle antenna device, and FIG. 2(C) is a bottom view of the vehicle antenna device. FIG. 3 is a side sectional view of the vehicle antenna device. FIG. 4 is a perspective view of the vehicle antenna device in a state where conductor plates 90 are disassembled, as seen from the lower side. FIG. 5 is a perspective view of the vehicle antenna device, as seen from the lower side. FIG. 6 is an enlarged sectional view taken along A-A in FIG. 2(C). FIG. 7(A) is a bottom view of a metal-made base 60 in FIG. 1. FIG. 7(B) is a rear sectional view of the metal-made base, FIG. 7(C) is a side view of the metal-made base, and FIG. 7(D) is a side sectional view of the metal-made base. FIG. 8(A) is a side sectional view of a resin base 70 in FIG. 1. FIG. 8(B) is a side view of the resin base, and FIG. 8(C) is a bottom view of the resin base. FIG. 9(A) is a side view of the conductor plate 90 in FIG. 1. FIG. 9(B) is a bottom view of the conductor plate, and FIG. 9(C) is a rear view of the conductor plate.

An antenna case 1 is made of a radio wave transmissive synthetic resin (a molded product made of a resin such as PC or PET), and formed into a shark fin shape in which the side surfaces are inwardly curved. An antenna base is configured by combining the metal-made base 60 with the resin-made base 70. The resin-made base 70 has through holes 72*a*, 72*b* in a middle portion of a planar portion 71. A pair of bosses (projections) 71*a* which is engaged with an inner edge portion of a mounting hole of the vehicle body are disposed on the lower surface (the surface on the side of the vehicle body) of the planar portion 71. The metal-made base 60 is smaller in area than the resin-made base 70, and attached (fixed) by eight screws 103 onto the planar portion 71 of the resin-made base 70 so as to close the through holes 72*a*, 72*b* of the resin-made base 70. The metal-made base 60 has: a planar portion 61 which is to cover the through holes 72*a*, 72*b*; and a feeding cylindrical portion (hollow threaded shaft portion) 62 which is downwardly projected from the planar portion 61, and in which a male thread for attachment to the vehicle body (for example, the roof that is the panel to which attachment is to be made) is formed on the outer circumference. Convex portions 61*a*, 61*b* (FIG. 4) which are to be fitted into the through holes 72*a*, 72*b* of the resin base 70 are disposed on the lower surface of the planar portion 61. The feeding cylindrical portion 62 extends from the convex portion 61*a* toward the lower side of the resin-made base 70. An amplifier board 50 is attached (fixed) by screwing or the like onto the planar portion 61. A pair of conductor plate springs (terminals) 51 is disposed on the amplifier board 50. An output cable 52 downwardly elongates from the amplifier board 50, and passes through the inside of the feeding cylindrical portion 62 so as to be drawn out to the outside. An annular sealing member 5 is disposed between the planar portion 71 of the resin-made base 70 and the vehicle body. The sealing member 5 is disposed in the periphery of the through holes 72*a*, 72*b* of the resin-made base 70, and sandwiched and pressed between the planar portion 71 of the resin-made base 70 and the vehicle body, thereby preventing water from penetrating through a gap between the resin-made base 70 and the vehicle body.

A pad 3 is an elastic member made of elastomer, rubber, or the like, and disposed on the resin-made base 70 so as to make a circle along the periphery of the resin-made base 70 or the vicinity thereof. The pad 3 functions as a blinder for the gap between the the lower end edge of the antenna case 1 and the vehicle body, and has also a simple waterproof function exerted between the resin-made base 70 and the vehicle body (the waterproof function is mainly exerted by the sealing member 5). The antenna case 1 is overlaid from the upper side on the resin-made base 70 while interposing the pad 3 between the antenna case 1 and the resin-made base 70, and attached (fixed) by nine screws 104 to the resin-made base 70. The antenna case 1 has a rib 1*a* (FIG. 3) for pressing the pad 3 against the whole circumference of the resin-made base 70. Therefore, penetration of water through a gap between the antenna case 1 and the resin-made base 70 can be avoided. Threaded-hole equipped bosses 1*b*, 1*c* (FIG. 3) are disposed on the ceiling portion of the antenna case 1. An LTE element 6, a satellite radio antenna 7, a capacitive element 10, and a coil element 40 which are antenna elements are disposed in a space between the antenna case 1 and the antenna base (the metal-made base 60 and the resin-made base 70). The capacitive element 10 and the coil element 40 are elements for an AM/FM antenna. The LTE element 6 and the satellite radio antenna 7 are examples of antenna elements other than elements for an AM/FM antenna.

The LTE element 6 is configured by a metal plate (conductor plate), and supported by a holder 6*c* which is erected from a board 6*b*. The board 6*b* is attached (fixed) by screwing or the like onto the planar portion 61 of the metal base 60. An output cable 6*a* elongates from the board 6*b*, and passes together with the output cable 52 of the amplifier board 50 through the inside of the feeding cylindrical portion 62 so as to be drawn out to the outside. The satellite radio antenna 7 is disposed on the planar portion 71 of the resin base 70. An output cable 7*a* of the satellite radio antenna 7 passes together with the output cable 6*a* of the LTE element 6 through the inside of the feeding cylindrical portion 62 so as to be drawn out to the outside.

The capacitive element 10 is configured by a metal plate (conductor plate), and bent in, for example, a squeezing process so as to have an umbrella-shaped curved surface portion 11 which is approximately parallel to an arcuate ceiling surface that is in the upper portion of the inside of the antenna case 1. In a state where the capacitive element 10 is fixed to the antenna case 1, the curved surface portion 11 is in proximity to the ceiling surface of the antenna case 1. A connecting portion 12 extends downwardly and rearwardly from a front end portion of the curved surface portion 11, to be formed into an L-like shape. The connecting portion 12 has a through hole 13 (FIG. 3) in a tip end portion. The upper surface of the periphery of the through hole 13 of the connecting portion 12 butts against the end surface of the threaded-hole equipped boss 1*b* (FIG. 3) in the antenna case 1. The lower surface of the periphery of the through hole 13 of the connecting portion 12 butts against the upper surface side of a conduction pattern 31*a* of a filter board 30 which will be described later. The lower surface side of the conduction pattern 31*a* of the filter board 30 butts against an upper terminal 45 of the coil element 40. In the curved surface portion 11, a through hole 14 (FIG. 1) is disposed in the rear side. The threaded-hole equipped boss 1*c* (FIG. 3) of the antenna case 1 is passed through the inside of the through hole 14.

An element holder 20 has a base portion 21, a cylindrical portion 22, a through hole 23, and a placement portion 24. The cylindrical portion 22 is raised from the base portion 21. The threaded-hole equipped boss 1*c* of the antenna case 1 is fitted into the inside of the cylindrical portion (FIG. 3). The element holder 20 is attached (fixed) to the antenna case 1 while interposing the capacitive element 10 between the element holder 20 and the antenna case 1, by a screw 102 which is screwed to the threaded-hole equipped boss 1*c*. Projections 22*a* are disposed in front and rear of the cylindrical portion 22, respectively. The projections 22*a* press the capacitive element 10 against the ceiling surface of the antenna case 1. The through hole 23 is disposed in the base portion 21, and located in front of the cylindrical portion 22. The element holder 20 has a space in which an upper portion of a bobbin 41 of the coil element 40 that will be described later is positioned and supported (fitted), below the through hole 23. The periphery and rear of the through hole 23 of the base portion 21 are formed as the placement portion 24 on which the filter board 30 is to be placed. The placement portion 24 will be described later. The filter board 30 is slid from the front side to be attached (provisionally fixed) to the placement portion 24.

As shown in FIG. 3, the coil element 40 is configured by forming a winding 42 around the bobbin 41 which is made of a resin. The upper terminal 45 is disposed (for example, pressingly inserted and fixed) in one end (upper end) of the bobbin 41. One end of the winding 42 is electrically connected to the upper terminal 45. A lower terminal 47 is disposed (for example, pressingly inserted and fixed) in the other end (lower end) of the bobbin 41. The other end of the winding 42 is electrically connected to the lower terminal 47. The upper terminal 45 is attached (fixed) to the threaded-hole equipped boss 1*b* of the antenna case 1 while interposing the filter board 30 (conduction pattern 31*a*) and the connecting portion 12 of the capacitive element 10 between the upper terminal 45 and the antenna case 1, by a screw 101. Namely, the screw 101 passes through a through hole 45*d* of the upper terminal 45, a through hole 31 of the filter board 30, and the through hole 13 of the connecting portion 12 of the capacitive element 10, and is screwed to the threaded-hole equipped boss 1*b* of the antenna case 1. Therefore, the coil element 40 and the capacitive element 10 are electrically connected to each other, and the filter board 30 is electrically connected between the coil element 40 and the capacitive element 10. Preferably, the screw 101 may have a spring washer so as to avoid a connection failure due to its loosening. A connection leg 47*b* of the lower terminal 47 is clamped by a pair of conductor plate springs 51 of the amplifier board 50. Therefore, the coil element 40 and the amplifier board 50 are electrically connected to each other.

In the planar portion 71 of the resin base 70, two conductor plates 90 are attached (fixed) to the surface (lower surface) opposite to a placement surface (upper surface) of the metal-made base 60, by eight screws 103. One of the conductor plates 90 is located in front of the feeding cylindrical portion 62, and the other conductor plate 90 is located in rear of the feeding cylindrical portion 62. The outer edge (three sides excluding a side facing the feeding cylindrical portion 62) of each of the conductor plates 90 is in proximity to the inner edge of the sealing member 5, and approximately coincides with the outer edge of the metal-made base 60 as seen in the axial direction (vertical direction) of the feeding cylindrical portion 62. As shown in FIG. 4, each of the conductor plates 90 has a screwed portion 93 in each of four corners of a corresponding planar portion 91. Each of the screwed portions 93 has a through hole 93*a* through which the corresponding screw 103 is passed, and is bent into an L-like shape so as to be raised to be higher than the planar portion 91 by one step. By contrast, eight concave portions 73 into which the screwed portions 93 of the conductor plates 90 enter respectively are disposed on the lower surface of the planar portion 71 of the resin base 70. A through hole 73*a* through which the screw 103 passes is disposed in each of the concave portions 73. The screws 103 cause the conductor plates 90 to be attached to the lower surface of the resin base 70, and the metal-made base 60 to be attached to the upper surface of the resin base 70. The metal-made base 60 and the conductor plates 90 are electrically connected to each other by the screws 103. Each of the conductor plates 90 has four plate spring portions 92 which are bent in an obliquely downward direction from the planar portion 91 so as to approach the side of the vehicle body. Tip end portions of the plate spring portions 92 face the side of the feeding cylindrical portion 62, and are contacted with the vehicle body roof (compressed by the vehicle body roof).

Figure 10:
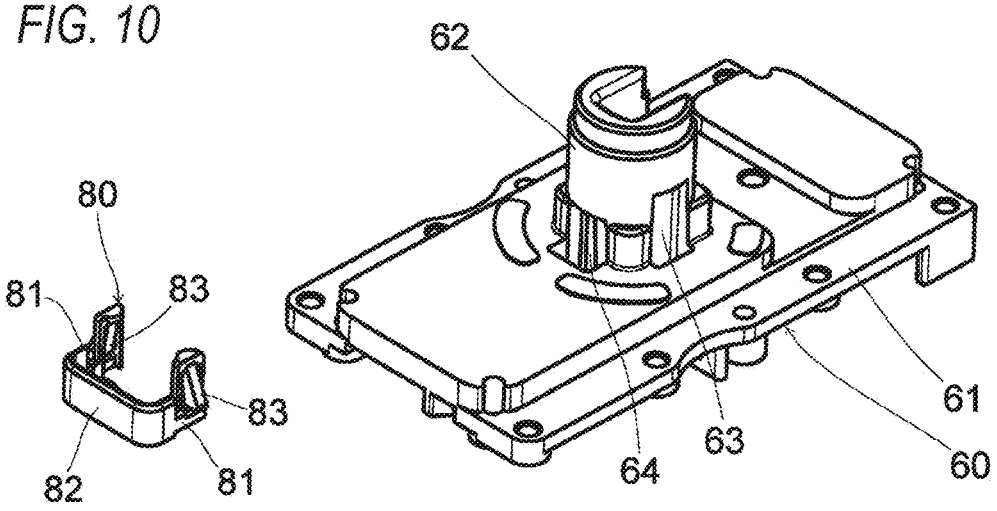
FIG. 10 is a perspective view of a disassembled state of the metal-made base 60 and a provisional fixing holder 80 of the vehicle antenna device.
Figure 11:
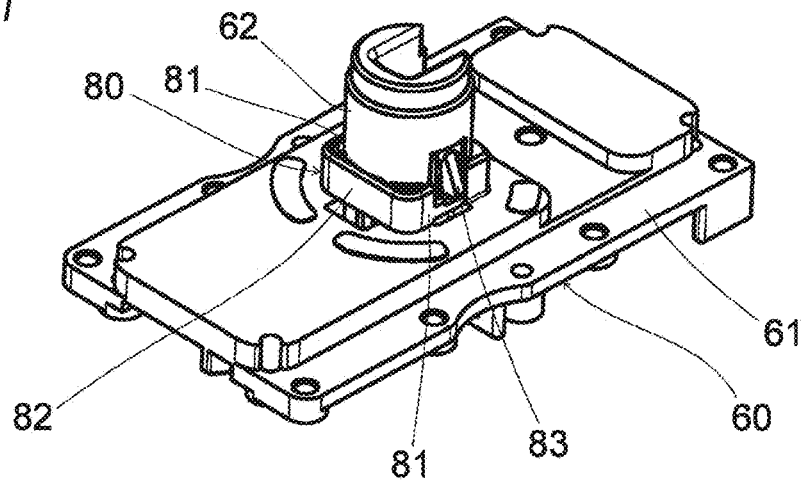
FIG. 11 is a perspective view of an assembled state of the metal-made base 60 and the provisional fixing holder 80 in FIG. 10.
Figure 12:
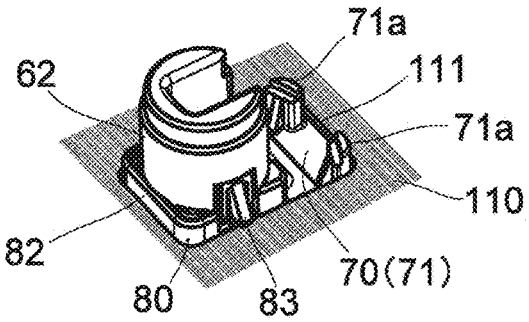
FIGS. 12(A) and 12(B) are external views of the vehicle antenna device in a state where the device is attached to a through hole 111 of a vehicle body roof 110, as seen from the lower side.
Figure 12:
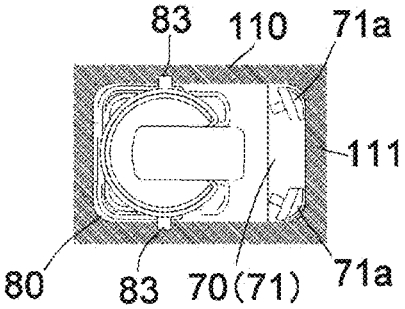

FIG. 10 is a perspective view of a disassembled state of the metal-made base 60 and the provisional fixing holder 80 of the vehicle antenna device. FIG. 11 is a perspective view of an assembled state of the metal-made base 60 and the provisional fixing holder 80 in FIG. 10. FIG. 12(A) is a perspective view of a state where the vehicle antenna device is attached to a through hole 111 of the vehicle body roof 110, as seen from the lower side. FIG. 12(B) is a bottom view of the state. The provisional fixing holder 80 which serves as the resin-made part has a U- or C-shaped external shape, and is engageable with (fittable into) the side surface of the feeding cylindrical portion 62 in a lateral direction perpendicular to the axial direction thereof. The provisional fixing holder 80 is engaged with the vehicle body roof 110 that serves as the panel to which attachment is to be made, in a state where the feeding cylindrical portion 62 is inserted from the outside into the through hole 111 of the vehicle body roof 10, thereby provisionally fixing the antenna device to the vehicle body roof 10. The provisional fixing holder 80 is made of, for example, a flexible resin, and has: a pair of clamping portions 81 which clamps the feeding cylindrical portion 62; a liaison portion 82 through which the clamping portions 81 are connected to each other; and latching claws 83 which are formed in tip end portions of the clamping portions 81, respectively, so as to be outwardly projected. The feeding cylindrical portion 62 has on the side surface a pair of first groove portions 63 (FIGS. 7(B) and 10) which is engaged with the provisional fixing holder 80, and one second groove portion 64 which is at the midpoint between the first groove portions 63. The provisional fixing holder 80 is attached to the feeding cylindrical portion 62 by being engaged with the first groove portions 63 and the second groove portion 64. Namely, the pair of clamping portions 81 is engaged with the pair of first groove portions 63 so as to sandwich the feeding cylindrical portion 62, and the liaison portion 82 is engaged with the second groove portion 64. In the state where the feeding cylindrical portion 62 to which the provisional fixing holder 80 is attached is inserted into the through hole 111 of the vehicle body roof 110, the latching claws 83 are caught by the inner surface of the roof, and can function as the provisionally fixation. As shown in FIGS. 12(A) and 12(B), the provisional fixing holder 80 is interposed between the feeding cylindrical portion 62 and an inner edge portion (inner circumferential portion) of the through hole 111 of the vehicle body roof 110 to prevent the both members from being directly contacted with each other, i.e., from being electrically connected to each other.

Figure 13:
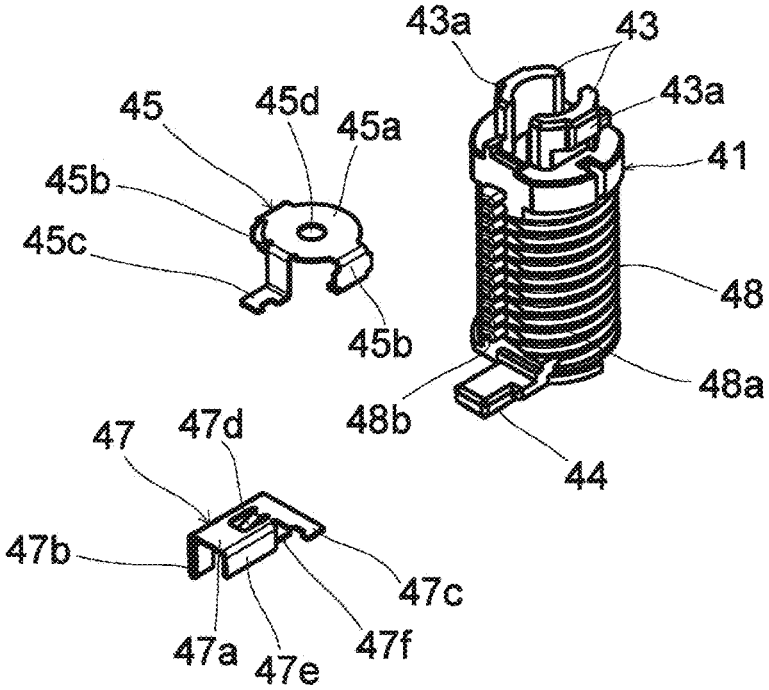
FIG. 13 is a perspective view of a disassembled state of a bobbin 41, an upper terminal 45, and a lower terminal 47 of a coil element 40 in FIG. 1.
Figure 14:
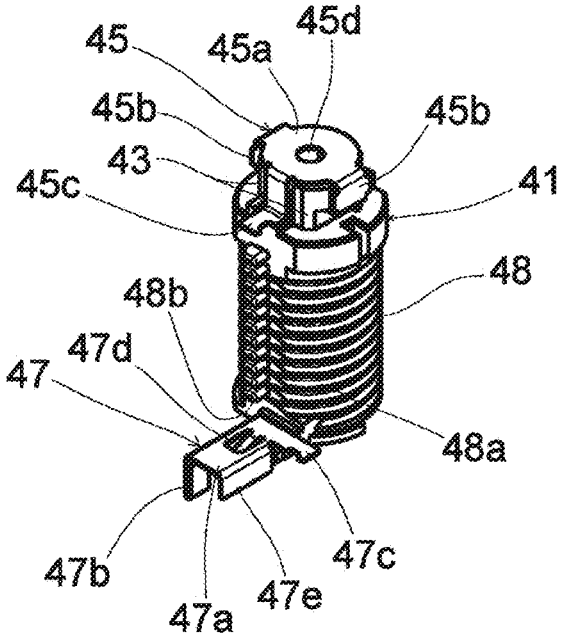
FIG. 14 is a perspective view of an assembled state of the bobbin 41, the upper terminal 45, and the lower terminal 47 in FIG. 13.

FIG. 13 is a perspective view of a disassembled state of the bobbin 41, the upper terminal 45, and the lower terminal 47 of the coil element 40 in FIG. 1. FIG. 14 is a perspective view of an assembled state of the bobbin 41, the upper terminal 45, and the lower terminal 47 in FIG. 13. FIGS. 15(A) to 15(H) are views illustrating steps of producing the coil element 40.

The upper terminal 45 has a base portion 45*a*, a pair of attaching legs 45*b*, and a winding terminal connecting portion (tab) 45*c*. A through hole 45*d* is disposed in a middle portion of the base portion 45*a*. The pair of attaching legs 45*b* is bent into a U-like shape with respect to the base portion 45*a*, and located in the opposite sides across the center of the base portion 45*a*, respectively. The winding terminal connecting portion 45*c* is bent into an L-like shape with respect to the base portion 45*a*, and located in a position which is different by 90 degrees from the attaching legs 45*b* about the through hole 45*d*.

The lower terminal 47 has an upper surface portion 47*a*, a connection leg 47*b*, a winding terminal connecting portion (tab) 47*c*, side surface portions 47*e*, and a lower surface portion 47*f*. A plate spring portion 47*d* which is bent in an obliquely downward direction is disposed in a middle portion of the upper surface portion 47*a*. The plate spring portion 47*d* has a function of preventing the bobbin 41 from rattling with respect to a lower terminal attaching portion 44 of the bobbin 41. The connection leg 47*b* is downwardly bent with respect to the base portion 45*a*. The winding terminal connecting portion 47*c* extends from the upper surface portion 47*a* to be projected toward the outside. The side surface portions 47*e* are downwardly bent with respect to the upper surface portion 47*a* at the both ends of the upper surface portion 47*a*, respectively. The lower surface portion 47*f* is a portion which is formed by bending the lower end of one of the side surface portions 47*e*, and extending the lower end approximately in parallel to the upper surface portion 47*a*. The lower terminal 47 is attached to the lower terminal attaching portion 44 in such a manner that the lower terminal attaching portion 44 is surrounded by the upper surface portion 47*a*, the side surface portions 47*e*, and the lower surface portion 47*f*.

The bobbin 41 has: upper terminal attaching portions 43 to which the upper terminal 45 is to be attached; the lower terminal attaching portion 44 to which the lower terminal 47 is to be attached; and a cylindrical winding barrel 48 in which the winding 42 is wound on the outer circumferential surface. The upper terminal attaching portions 43 are erected on the upper end surface of the winding barrel 48 while being distributed on the both sides of the center axis of the winding barrel 48. The upper terminal attaching portions 43 have a pair of convex portions 43*a* which is outwardly projected in the opposite directions to each other. The pair of convex portions 43*a* is engaged with the pair of attaching legs 45*b* of the upper terminal 45. The lower terminal attaching portion 44 is disposed so as to protrude toward the outside in the lower end portion of the winding barrel 48. A guide groove 48*a* which is the winding path of the winding 42, and a plurality of projections 48*b* which are in positions along the winding path of the winding 42 are disposed on the outer circumferential surface of the winding barrel 48. The guide groove 48*a* spirally extends around the outer circumferential surface of the winding barrel 48. At least one of the projections 48*b* is disposed in each of a plurality of circumferential positions (circumferential positions where the later-described winding terminal connecting portion 45*c* of the upper terminal 45 can exist) on the outer circumferential surface of the winding barrel 48. In the illustrated example, the projections 48*b* are disposed in two circumferential positions which are separated from each other by 180 degrees, and which are on the outer circumferential surface of the winding barrel 48, in plural numbers (ten in one of the positions, and eleven in the other position). One of the circumferential positions where the projections 48*b* are disposed coincides with the circumferential position of the winding terminal connecting portion 45*c* of the upper terminal 45. Each of the projections 48*b* functions as a hooking portion in the case where the winding end portion of the winding 42 is drawn out in the axial direction. From the viewpoint of ensuring of strength, the projections 48*b* are formed into a planer shape.

Figure 15:
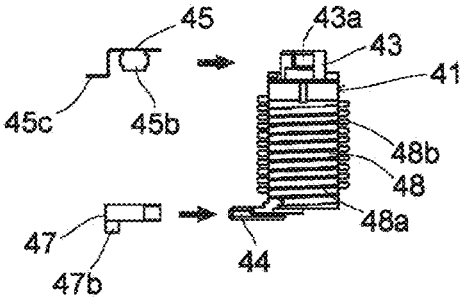
FIGS. 15(A) to 15(H) are views illustrating steps of producing the coil element 40.
Figure 15:
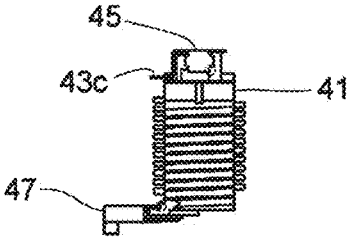
Figure 15:
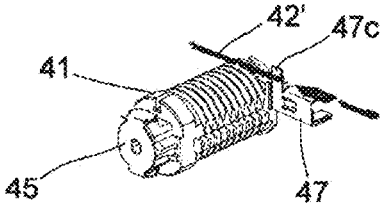
Figure 15:
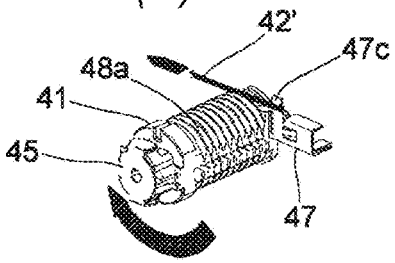
Figure 15:
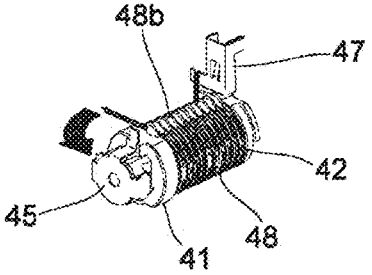
Figure 15:
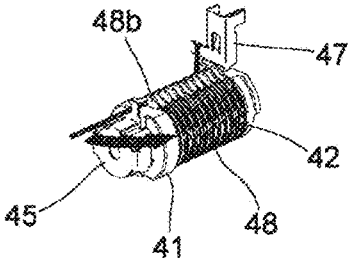
Figure 15:
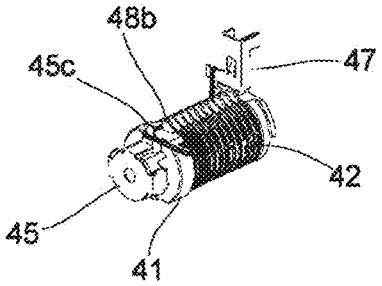
Figure 15:
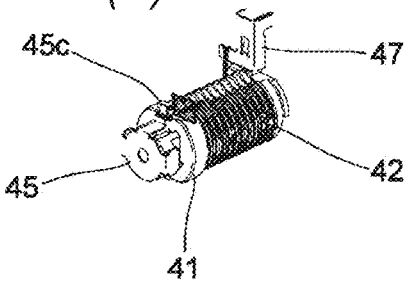

As shown in FIGS. 15(A) and 15(B), when the coil element 40 is to be assembled, first, the upper terminal 45 and the lower terminal 47 are slidingly attached to the upper terminal attaching portions 43 and the lower terminal attaching portion 44 of the bobbin 41, respectively. As shown in FIG. 15(C), then, a bent end portion of a wire 42' which is to be configured as the winding 42 is hooked to the winding terminal connecting portion 47*c* of the lower terminal 47, and connected and fixed thereto by soldering, welding, or the like. As shown in FIGS. 15(D) and 15(E), then, the winding 42 is wound around the outer circumferential surface (guide groove 48*a*) of the winding barrel 48 of the bobbin 41, while rotating the bobbin 41. The winding pitch of the winding 42 is determined by the arrangement pitch of the guide groove 48*a*. As shown in FIGS. 15(F), 15(G), and 15(H), then, the winding end portion of the winding 42 is hooked on the predetermined projection 48*b* of the winding barrel 48, the terminal of the winding 42 is drawn out in the axial direction, the terminal of the winding 42 is connected and fixed to the winding terminal connecting portion 45*c* of the upper terminal 45 by soldering, welding, or the like, and an excess portion is cut away. The above-described series of operations can be conducted by an automatic winding machine. As a result, the coil element 40 is completed. The coil element 40 is installed into the antenna case 1 in following manner. First, the filter board 30 and the upper terminal 45 are fixed together with the capacitive element 10 to the threaded-hole equipped boss 1*b* of the antenna case 1 by the screw 101. Then, the connection leg 47*b* of the lower terminal 47, and the conductor plate springs 51 of the amplifier board 50 are positioned relative to each other, and an assembly of the amplifier board 50, the metal-made base 60, and the resin-made base 70 is attached to the antenna case 1 by, for example, screwing. Alternatively, the upper terminal 45 may be attached while being inverted by 180 degrees with respect the bobbin 41. When the projection 48*b* on which the winding end portion of the winding 42 is to be hooked is changed, and, as required, the upper terminal 45 is inverted by 180 degrees, the number of turns of the winding 42 can be changed in units of 0.5 turn.

Figure 16:
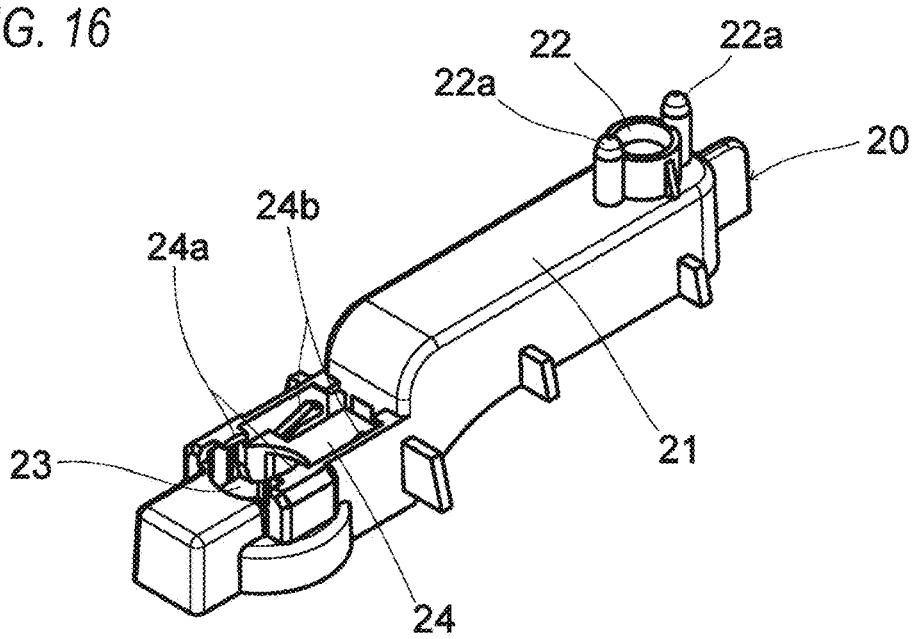
FIG. 16 is a perspective view of an element holder 20 in FIG. 1.
Figure 17:
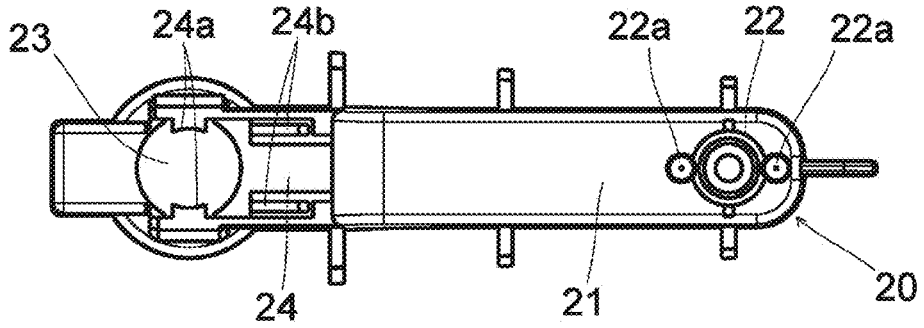
FIG. 17 is a plan view of the element holder.
Figure 18:
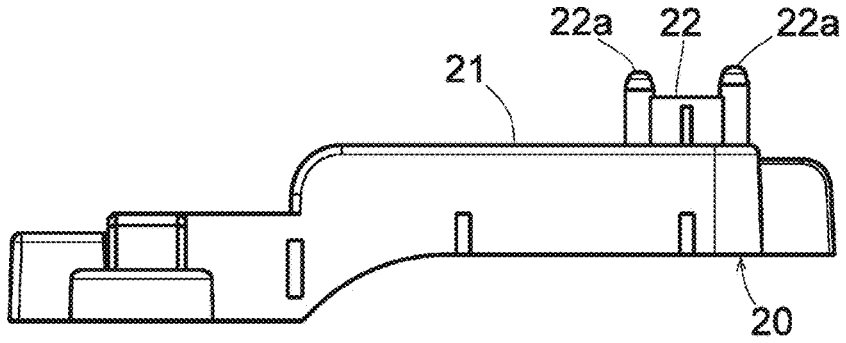
FIG. 18 is a side view of the element holder.
Figure 19:
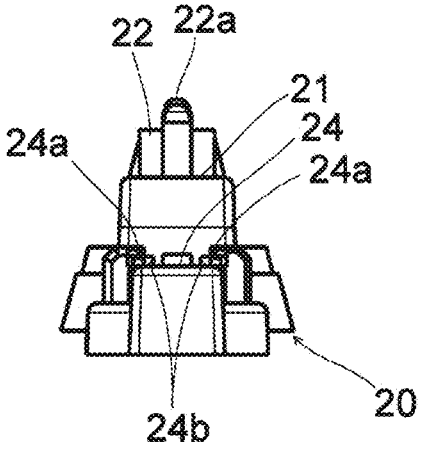
FIG. 19 is a front view of the element holder.
Figure 20:
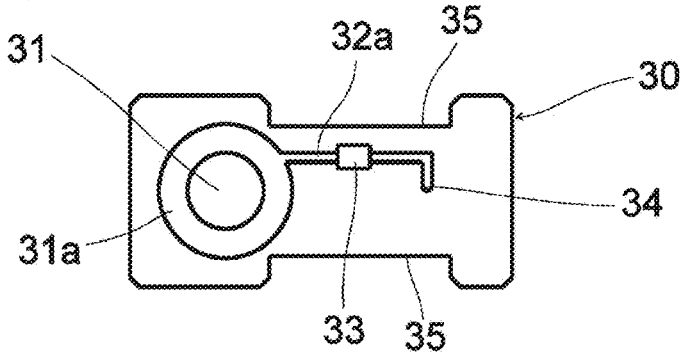
FIGS. 20(A), 20(B) and 20(C) are external views of a filter board 30 in FIG. 1.
Figure 20:
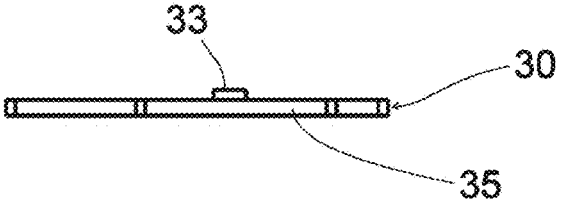
Figure 20:
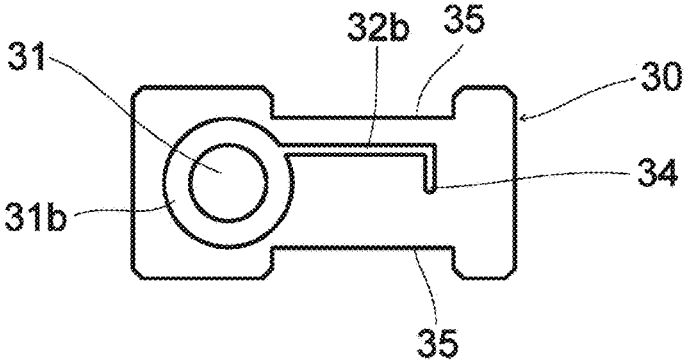
Figure 21:
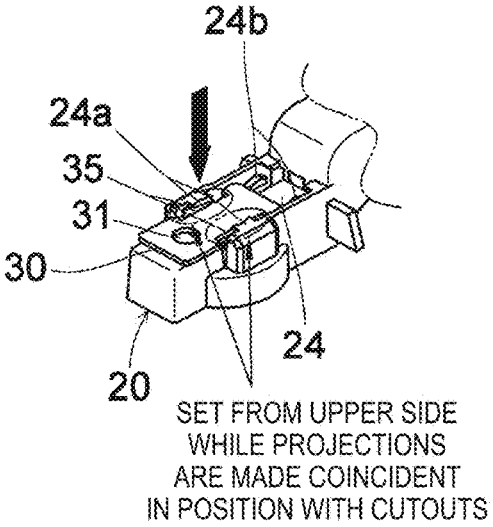
FIGS. 21(A) and 21(B) are views illustrating processes of attaching the filter board 30 to the element holder 20.
Figure 21:
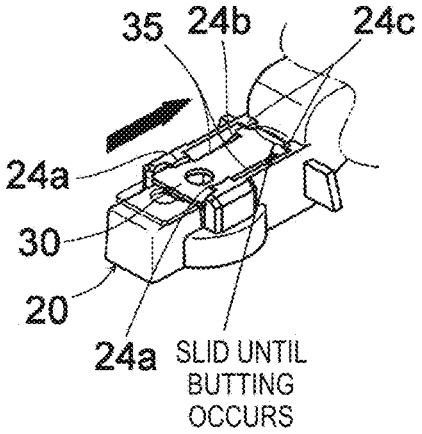
Figure 22:
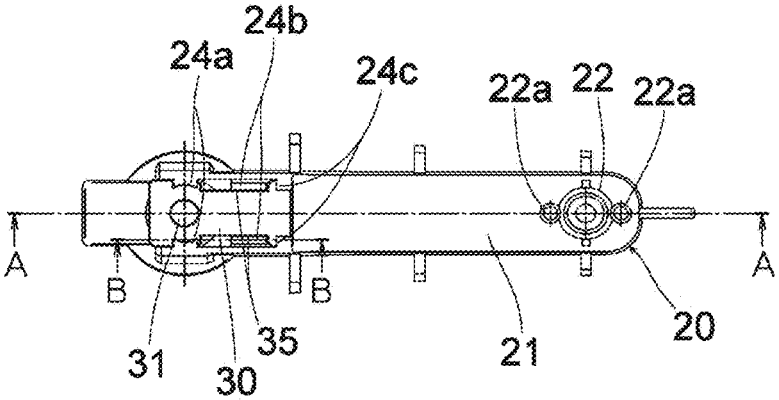
FIG. 22 is a plan view of the element holder 20 which provisionally holds the filter board 30.
Figure 23:
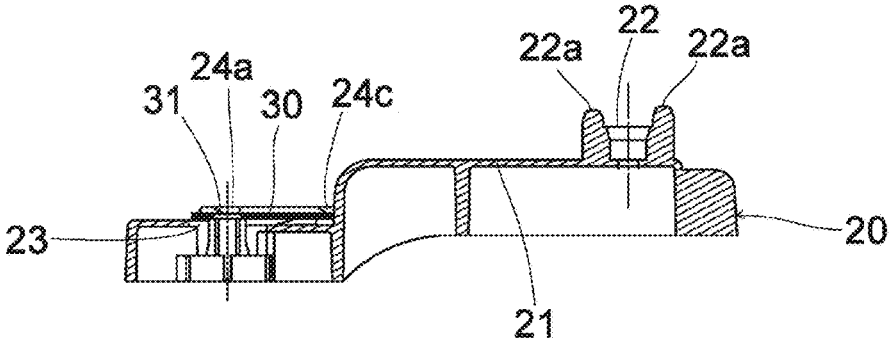
FIG. 23 is a sectional view taken along A-A in FIG. 22.
Figure 24:
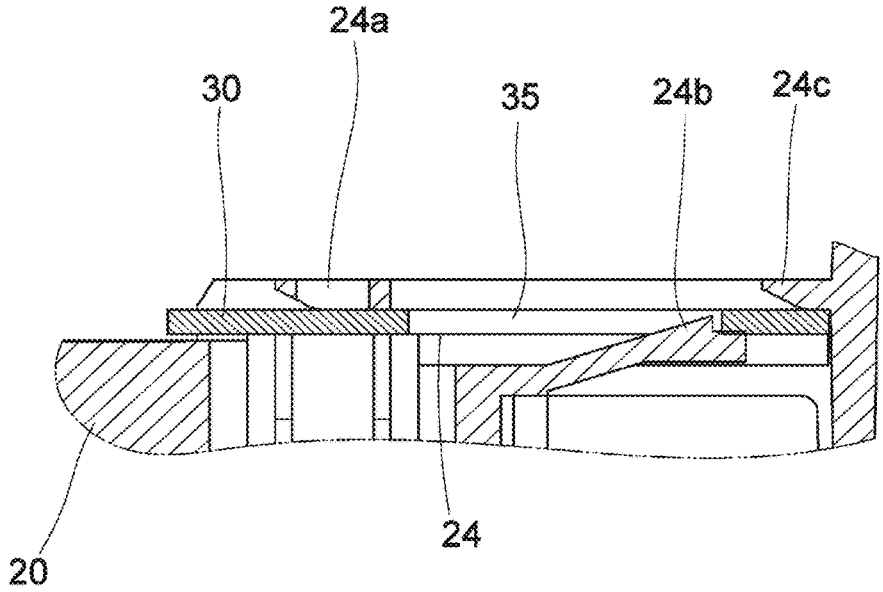
FIG. 24 is an enlarged sectional view taken along B-B in FIG. 22.

FIG. 16 is a perspective view of the element holder 20 in FIG. 1. FIG. 17 is a plan view of the element holder 20. FIG. 18 is a side view of the element holder 20, and FIG. 19 is a front view of the element holder 20. FIG. 20(A) is a plan view of the filter board 30 in FIG. 1. FIG. 20(B) is a side view of the filter board 30, and FIG. 20(C) is a bottom view of the filter board 30. FIGS. 21(A) and 21(B) are views illustrating processes of attaching the filter board 30 to the element holder 20. FIG. 22 is a plan view of the element holder 20 which provisionally holds the filter board 30. FIG. 23 is a sectional view taken along A-A in FIG. 22. FIG. 24 is an enlarged sectional view taken along B-B in FIG. 22.

The element holder 20 has the placement portion 24 on which the filter board 30 is to be placed. Latching claws 24*b* are disposed on the both sides of the placement portion 24, respectively. A pair of projecting portions 24*a* is inwardly projected from the both upper sides of the through hole 23, respectively. The filter board 30 has a pair of cutouts 35 in the right and left sides. In the case where the filter board 30 is to be provisionally fixed to the placement portion 24 of the element holder 20, the filter board 30 is placed from the upper side on the placement portion 24 as shown in FIG. 21(A) while locating the cutouts 35 at the positions of the projecting portions 24*a*, and the filter board 30 is rearwardly slid until butting occurs as shown in FIG. 21(B). Then, the pair of latching claws 24*b* is engaged with the edge portions of the cutouts 35 to latch (provisionally fix) the filter board 30. Moreover, the upper surface of the filter board 30, and the pair of projecting portions 24*a* and a pair of projecting portions 24*c* are engaged (face-to-face contacted) with each other, and the filter board 30 is prevented from upwardly slipping off. The filter board 30 has the conduction pattern 31*a* on the upper surface of the periphery of the through hole 31, and a conduction pattern 31*b* on the lower surface, and further has an inductive pattern 32*a* on the upper surface, and an inductive pattern 32*b* on the lower surface. The inductive patterns 32*a*, 32*b* extend from the conduction patterns 31*a*, 31*b*, respectively, and are connected to each other by a through hole 34. A chip capacitor 33 is disposed in the middle of the inductive pattern 32*a*. When the element holder 20 is fixed together with the coil element 40 to the antenna case 1 by the screw 101, the filter board 30 is clamped and fixed together with the capacitance element 10 between the antenna case 1 and the coil element 40. At this time, the conduction pattern 31*a* on the upper surface of the filter board 30, and the capacitive element 10 are electrically connected to each other, and the conduction pattern 31*b* on the lower surface of the filter board 30, and the upper terminal 45 are electrically connected to each other.

Figure 25:
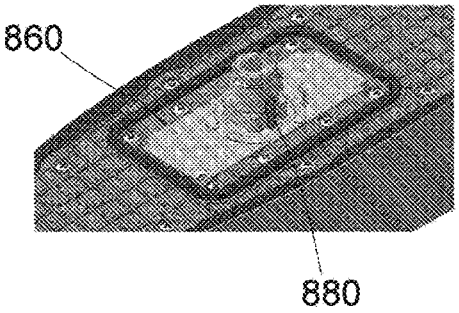
FIGS. 25(A) and 25(B) are perspective views of main portions of a vehicle antenna device according to a comparison example, as seen from the lower side.
Figure 25:
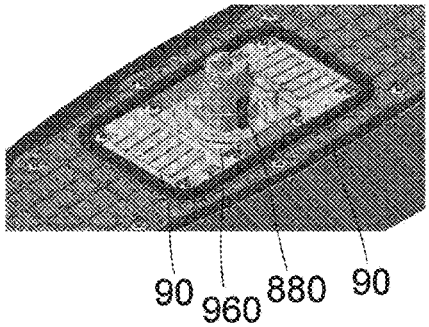

FIG. 25(A) is a perspective view of main portions of a vehicle antenna device according to Comparison example 1, as seen from the lower side. FIG. 25(B) is a perspective view of main portions of a vehicle antenna device according to Comparison example 2, as seen from the lower side. Comparison example 1 shown in FIG. 25(A) is a device of the conventional type in which the conductor plates 90 in the embodiment are not disposed, and a holder 880 for provisional fixing to the vehicle body is attached from the upper side of a metal base 860, and which is not provided with a configuration for preventing the vehicle body roof and the metal-made base 860 from being directly contacted with each other. By contrast, Comparison example 2 shown in FIG. 25(B) has the conductor plates 90 in the embodiment, but, similarly with Comparison example 1, is not provided with a configuration for preventing the vehicle body roof and a metal-made base 960 from being directly contacted with each other.

Figure 26:
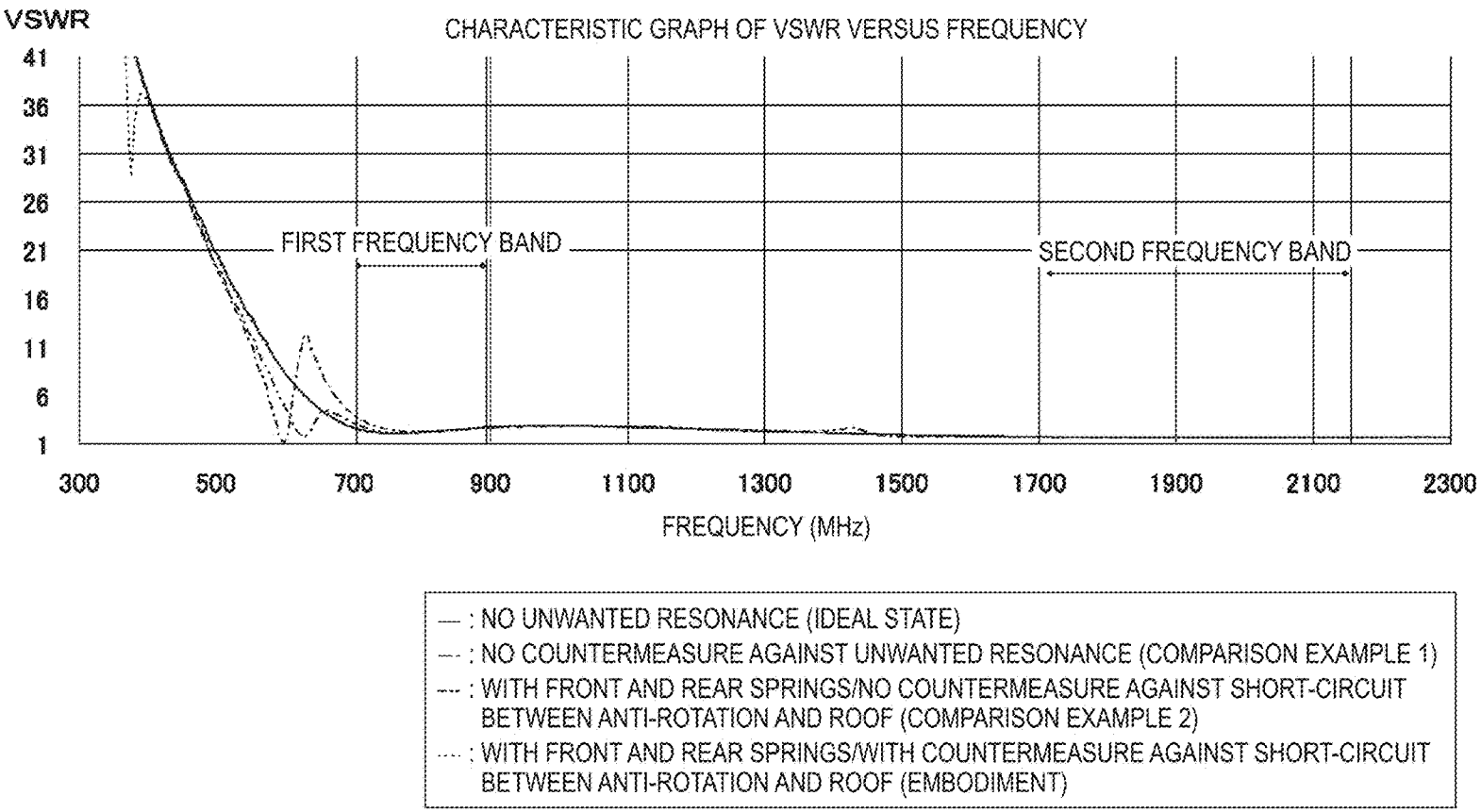
FIG. 26 is a characteristic graph of VSWR versus frequency of vehicle antenna devices of an ideal state where unwanted resonance does not occur, the embodiment, and Comparison examples 1 and 2.
Figure 27:
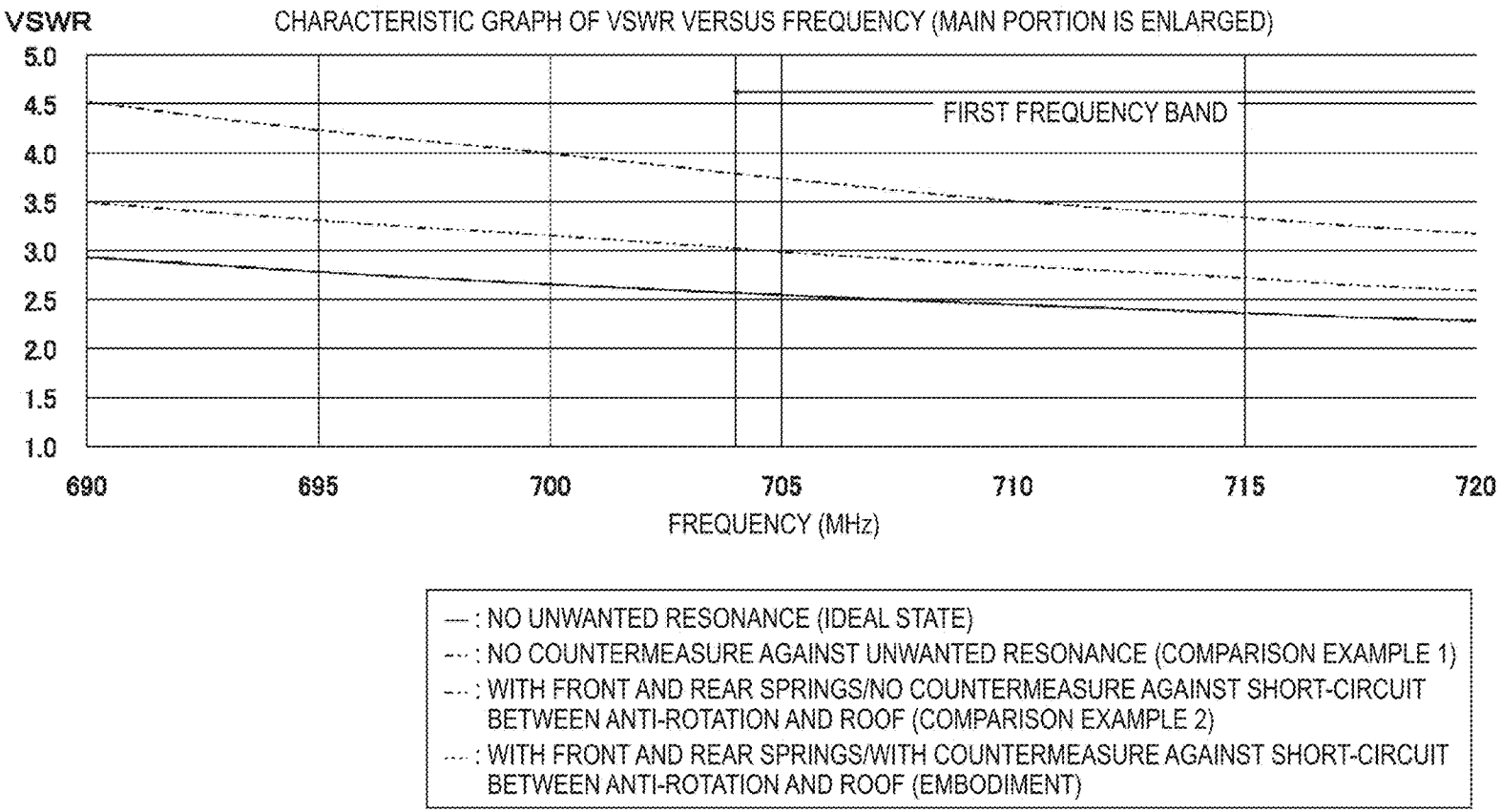
FIG. 27 is a characteristic graph in which the vicinity of 700 MHz in FIG. 26 is enlarged.

FIG. 26 is a characteristic graph of VSWR versus frequency of vehicle antenna devices according to an ideal state where unwanted resonance does not occur, the embodiment, and Comparison examples 1 and 2. FIG. 27 is a characteristic graph in which the vicinity of 700 MHz in FIG. 26 is enlarged. The first and second frequency bands shown in these drawings are frequency bands used in the LTE. In the case of the second frequency band, in any configuration, characteristics which are close to the characteristic according to the ideal state are obtained. In the case of the first frequency band, in the configurations of Comparison examples 1 and 2, by contrast, the characteristics are largely deviated from the characteristic according to the ideal state as enlargedly shown in FIG. 27. In the configuration of the embodiment, on the other hand, the characteristic is relatively close to the characteristic according to the ideal state. The characteristic according to the embodiment which is close to the characteristic according to the ideal state is attained by the effect because of a phenomenon in which the capacitance is increased by the interposition of the conductor plate 90 between the metal-made base 60 and the vehicle body roof, and the resonance frequency is shifted to a frequency band that is lower than the first frequency band, and by the effect because of the configuration in which direct contact between the metal-made base 60 and the inner circumference of the mounting hole of the vehicle body roof is avoided by the provisional fixing holder 80 (the effect because of the fact that an unintended conduction path is not formed). In the configuration in the embodiment, characteristics in a band (300 MHz to 400 MHz) which is not in the first and second frequency bands are largely deviated from the characteristic according to the ideal state. However, this is no problem since this band is not used. In other words, according to the configuration in the embodiment, the frequency band in which deviation of the VSWR occurs due to unwanted resonance is shifted into an unused band, whereby the VSWR in the used frequency band can be made close to the VSWR in the ideal state (a reduction in the antenna gain is prevented).

According to the embodiment, it is possible to attain the following effects.

(1) The conductor plates 90 in the resin-made base 70 are disposed on the surface opposite to the placement surface of the metal-made base 60. Therefore, it is possible to avoid the reduction in the antenna gain since unwanted resonance due to an event that the metal-made base 60 has a resonance point according to the distance with respect to the vehicle body roof (ground) is occurred in a required frequency band.

(2) Since the conductor plates 90 have the plate spring portions 92, and the plate spring portions 92 are compressed by the vehicle body roof, the plate spring portions 92 and the vehicle body roof can be surely contacted with each other even when the curvature of the vehicle body roof is changed, and therefore the reduction in the antenna gain is surely avoided.

(3) Since each of the plate spring portions 92 is branched into a plurality of sections, many contacts can be ensured even when the curvature of the vehicle body roof is large.

(4) Since the filter board 30 is disposed between the capacitive element 10 and the coil element 40, an adverse influence due to interferences between the antenna elements in the antenna case 1 can be reduced. Specifically, it is possible to avoid the reduction in the antenna gain of the LTE element 6 by a phenomenon that the second- or third-harmonics of the capacitive element 10 and the coil element 40 (AM/FM) enter the LTE element 6.

(5) The filter board 30 has the configuration where the filter board 30 is fixed by the screw 101 in the state (stacked stated) where the filter board 30 is sandwiched between the upper terminal 45 of the coil element 40 and the connecting portion 12 of the capacitive element 10, and the filter board 30 is electrically connected between the capacitive element 10 and the coil element 40 by the screwing. Therefore, the mechanical fixation and the electrical connection of the filter board 30 can be performed in a lump and easily, and the assemblability is excellent.

(6) Since the element holder 20 has the configuration where the element holder 20 has the placement portion 24 on which the filter board 30 is to be placed, and the filter board 30 is provisionally fixed to the predetermined position by the latching claws 24*b* and the projecting portions 24*a*, 24*c*, positioning of the filter board 30 is not required in the assembling process, and the assemblability is excellent.

Although the present invention has been described with reference to the embodiment, it is obvious to those skilled in the art that the components and processing processes in the embodiment can be variously modified within the scope of the claims. Hereinafter, modifications will be described.

Even when each of the conductor plates 90 is configured by a flat plate having no plate spring portions 92, a certain level of effects can be attained in prevention of reduction of the antenna gain. Even when the conductor plates 90 are not conductive with the metal-made base 60, a certain level of effects can be attained in prevention of reduction of the antenna gain. The outer edge (three sides excluding the side facing the feeding cylindrical portion 62) of each of the conductor plates 90 may be outside the outer edge of the metal-made base 60 as seen in the axial direction (vertical direction) of the feeding cylindrical portion 62.

REFERENCE SIGNS LIST

1 antenna case, 1*a* rib, 1*b*, 1*c* threaded-hole equipped boss, 3 pad, 5 sealing member, 6 LTE element, 6*a* output cable, 6*b* board, 6*c* holder, 7 satellite radio antenna, 7*a* output cable, 10 capacitive element, 11 curved surface portion, 12 connecting portion, 13, 14 through hole, 20 element holder, 21 base portion, 22 cylindrical portion, 22*a* projection, 23 through hole, 24 placement portion, 24*a* projecting portion, 24*b* latching claw, 24*c* projecting portion, 30 filter board, 31 through hole, 31*a* conduction pattern, 32*a*, 32*b* inductive pattern, 33 chip capacitor, 34 through hole, 35 cutout, 40 coil element, bobbin, 42 winding, 42' wire, 43 upper terminal attaching portion, 43*a* convex portion, 44 lower terminal attaching portion, 45 upper terminal (first terminal), 45*a* base portion, 45*b* attaching leg, 45*c* winding terminal connecting portion (tab), 45*d* through hole, 47 lower terminal (second terminal), 47*a* upper surface portion, 47*b* connection leg, 47*c* winding terminal connecting portion (tab), 47*d* plate spring portion, 47*e* side surface portion, 47*f* lower surface portion, 48 winding barrel, 48*a* guide groove, 48*b* projection, 50 amplifier board, 51 conductor plate spring (terminal), 52 output cable, 60 metal-made base (conductive base), 61 planar portion, 61*a*, 61*b* convex portion, 62 feeding cylindrical portion (hollow threaded shaft portion), 63 first groove portion, 64 second groove portion, 65 threaded hole, 70 resin-made base (insulative base), 71 planar portion, 71*a* boss (projection), 72*a*, 72*b* through hole, 73 concave portion, 73*a* through hole, 80 provisional fixing holder, 81 clamping portion, 82 liaison portion, 83 latching claw, conductor plate, 91 planar portion, 92 plate spring portion, 93 screwed portion, 93*a* through hole, 101, 102, 103, 104 screw

The invention claimed is:

1. A vehicle antenna device comprising:

an antenna base;

an antenna case which is overlaid on the antenna base; and an antenna element and an amplifier board which are disposed inside the antenna case, wherein the antenna element has a capacitive element and a coil element, and a filter board is disposed between the capacitive element and the coil element, the coil element is configured by forming a winding around a bobbin, a first terminal to which one end of the coil element is electrically connected is disposed on a side of one end of the bobbin, and a lower surface of the filter board is in contact with and electrically connected to the first terminal, and an upper surface of the filter board is in contact with and electrically connected to the capacitive element.

2. The vehicle antenna device according to claim 1, wherein connecting portions of the first terminal, the filter board, and the capacitive element are screwed to the antenna case in a state where the connecting portions overlap with one another, and electrically connected to one another at the screwed portions.

3. The vehicle antenna device according to claim 1, further comprising an element holder which supports the capacitive element and the coil element, wherein the element holder has a placement portion on which the filter board is to be placed.

4. The vehicle antenna device according to claim 1, wherein the antenna element includes another antenna element for a frequency band which is different from a frequency band received by the capacitive element and the coil element.

5. The vehicle antenna device according to claim 1, wherein the filter board has a pattern on one surface, and a pattern on the other surface, and the pattern on the one surface is electrically connected to the capacitive element, and the pattern on the other surface is electrically connected to the coil element.

6. The vehicle antenna device according to claim 1, wherein the filter board is clamped between the capacitive element and the coil element.

7. The vehicle antenna device according to claim 1, further comprising an element holder which supports the coil element, wherein the element holder has a placement portion on which the filter board is to be placed.

8. The vehicle antenna device according to claim 7, wherein the placement portion slidably supports the filter board.

9. A vehicle antenna device comprising:

an antenna base;

an antenna case which is overlaid on the antenna base;

an antenna element and an amplifier board which are disposed inside the antenna case; and an element holder which supports at least one of the elements, wherein the antenna element has two elements, a filter board is disposed between the two elements, the element holder has a placement portion on which the filter board is to be placed, the placement portion slidably supports the filter board, and the placement portion has a latching claw which latches the filter board at a predetermined slide position.

10. The vehicle antenna device according to claim 9, wherein one of the two elements is a capacitive element, and the other of the two elements is a coil element.

11. The vehicle antenna device according to claim 10, wherein the element holder supports the capacitive element and the coil element.

* * * * *